US005363291A

United States Patent [19]

Steiner

[11] Patent Number: 5,363,291

[45] Date of Patent: Nov. 8, 1994

[54] PORTABLE LIGHT ASSEMBLY

[75] Inventor: Gregory A. Steiner, Lisle, Ill.

[73] Assignee: New Erra Group, Inc., Lombard, Ill.

[21] Appl. No.: 144,331

[22] Filed: Nov. 1, 1993

[51] Int. Cl.[5] ..... F21L 7/00

[52] U.S. Cl. ..... 362/191; 362/106; 362/200

[58] Field of Search ..... 362/190, 191, 200, 201, 362/157, 103–109, 98, 99, 226

[56] References Cited

U.S. PATENT DOCUMENTS

| | | | |
|---|---|---|---|
| 3,866,035 | 2/1975 | Richey, Jr. | 362/200 |
| 4,076,976 | 2/1978 | Fenton | 362/104 |
| 4,432,042 | 2/1984 | Zeller | 362/191 |
| 4,974,130 | 11/1990 | Friedman | 362/191 |
| 5,183,324 | 2/1993 | Thomas | 362/108 |

*Primary Examiner*—James C. Yeung
*Attorney, Agent, or Firm*—Basil E. Demeur; Alan B. Samlan

[57] ABSTRACT

There is disclosed a two-piece portable light assembly adapted for illuminating and attention focusing with respect to a logo or other design, consisting of a base formed by a housing for accommodating a power source and appropriate leads from the power source extending therefrom. The housing includes a pair of stakes which are interconnected with the power source leads, the stakes extending laterally outwardly from the housing in parallel relation. The portable light assembly is completed by a light carrying ledge which is provided with a rear wall having a pair of stake apertures formed in the rear wall, and a light bulb positioned in a light bulb aperture formed in the ledge wall extending outwardly from the rear wall. The light bulb has a pair of leads which extend into the stake apertures, such that when the stakes from the housing are inserted into the stake apertures, the circuitry between the power source and the light bulb is established. The portable light assembly is adapted to have a sheet of perforatable material interposed between the housing and the ledge, the material having a logo or other similar design intended to be illuminated. When in position, the light bulb carried in the ledge of the light assembly will illuminate the logo.

8 Claims, 1 Drawing Sheet

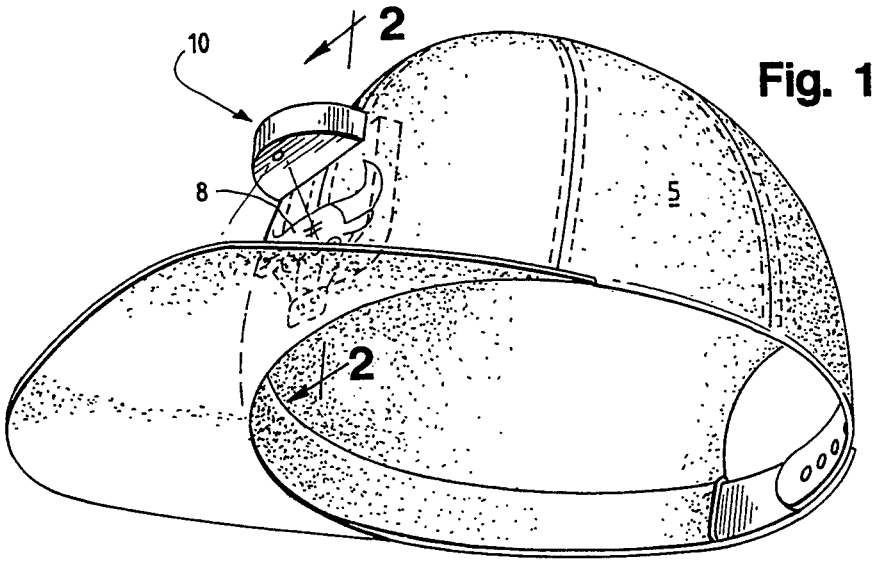
Fig. 1
Fig. 2
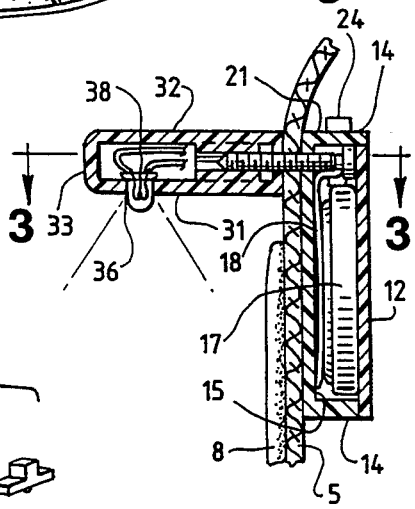
Fig. 4
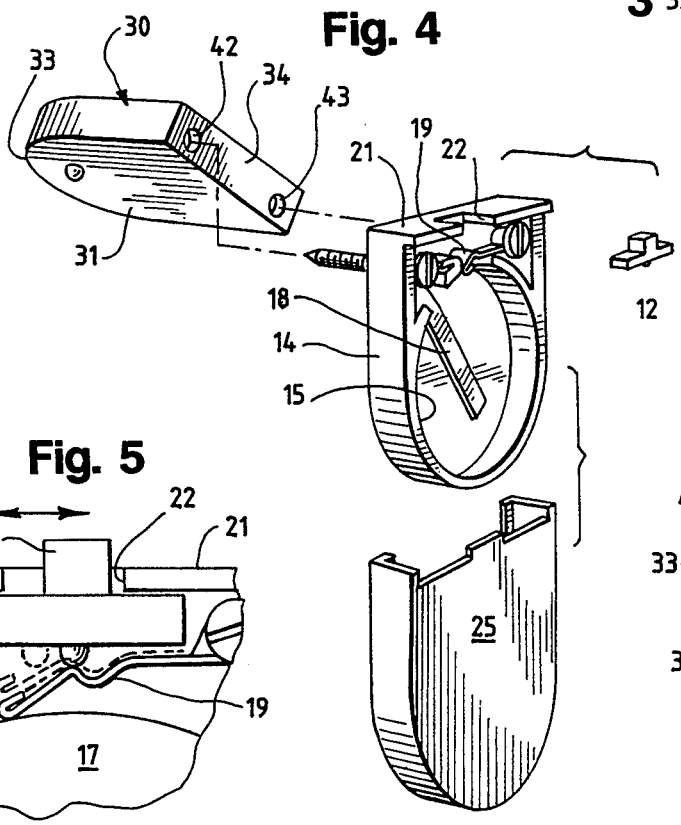
Fig. 3
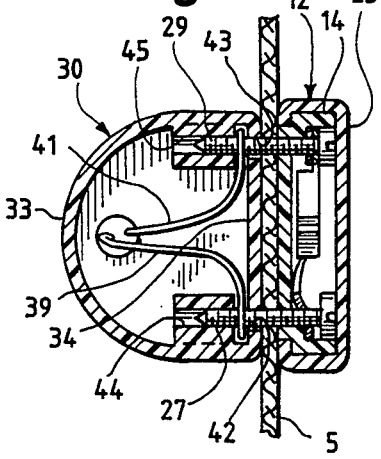
Fig. 5
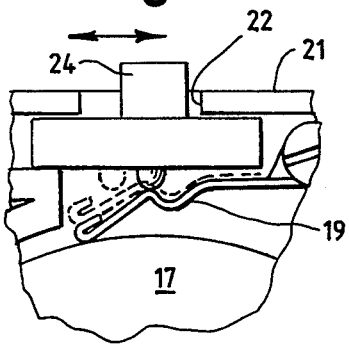

PORTABLE LIGHT ASSEMBLY

BACKGROUND OF THE INVENTION

The present invention deals with a portable light assembly especially adapted for the purpose of illuminating logos or other designs as a novelty and attention focusing device. It is especially and ideally suited for focusing attention and illuminating logos of the type that are generally found on hats such as ball caps. A typical example is a ball cap containing the logo of a certain sports team, such hats being quite common and worn by virtually all members of the public.

Generally, in the past, attempts to provide portable light assemblies for lighting garments, caps or other such pieces of wearing apparel have entailed rather cumbersome devices necessitating wires, battery packs and the like. Hence, such devices have been heavy, encumbersome, and have generally not realized any degree of commercial success. Further, generally such prior art devices have not been sufficiently compact such that they could be utilized for illuminating a small part of a garment or a logo, for example as contained on a hat.

The present invention is intended to provide a small and compact but very effective portable light assembly especially adapted for illuminating logos of the type which may be contained on clothing, caps, or other apparel. The principal requirement for the use of the portable light assembly of the present invention is that the logo or design intended to be illuminated be contained on a material which is perforatable by means of a metallic prong such that the materiel may be interposed between the two components of the light assembly of the present invention.

Insofar as prior art devices are concerned, as was indicated previously, generally such devices have been cumbersome, and too bulky for general use. For this reason, such devices have not generally been commercially successful. A device similar to applicant's device, however, is shown in U.S. Pat. No. 4,076,976 which is directed to a two-component light assembly intended to emit a flashing light in which a miniature circuit board has a pair of sockets and pin receiving openings formed therein. The light-emitting diode is contained on a board having a pair of stakes which may be inserted into the pin receiving openings with the item of jewelry interposed therebetween. As indicated therein, the purpose and intention of the light-emitting diode is to present a flashing light, and hence, the circuitry is designed with a steady flashing circuit such that the light may be incorporated in an item of jewelry for attention getting purposes. Clearly, the light is not intended to be a steady circuit for illumination purposes, and indeed, the light positioned on the board as defined by the subject patent would not adequately illuminate a logo or a design on an item of clothing since the light is located on a flat board, and once installed into the housing, emanates flashing light in a 360 degree dimension.

The present invention is intended as an improvement over the art as indicated above, and it is intended especially as an illumination and attention getting device for logos or other designs as may be contained on an item of apparel.

OBJECTS AND ADVANTAGES

It is therefore the principal object of the present invention to provide a portable light assembly consisting of two components, one component intended for positioning behind an item of apparel containing a logo, and the light assembly intended for positioning on the other surface of the item of clothing in a position immediately above the logo to be illuminated, the light carrying ledge having prongs which are received by the housing containing the power source such that once connected, a circuit is established for powering the light for illumination purposes.

In connection with the foregoing object, it is a further object of the present invention to provide a portable light assembly of the type described wherein the portable light assembly consists of a two-component system, the first component being a housing for accommodating a power source and the related circuitry and leads from the power source which are connected to a pair of stakes emanating therefrom and extending laterally outwardly from the housing, one of each of the stakes being a positive lead and the other being a negative lead. The assembly is completed by a light carrying ledge bounded by a rear wall, a top and bottom wall, front and side walls. A light is carried in the ledge adjacent the front wall thereof and spaced away from the rear wall a distance, the light containing a pair of leads leading to a stake-receiving aperture located in the rear wall. The improvement herein consists of providing the light in a ledge assembly such that the light may be spaced forwardly of the item of apparel interposed between the light ledge and the power source housing, and pointed in a downward direction such that once illuminated, the light can be directed at the logo for illumination purposes.

Further objects and advantages will become apparent by reference to the following description taken in conjunction with the accompanying drawings which follow hereinafter. The invention, both as to its method of operation, and organization will be better understood by reference to the drawings and specifications following below.

BRIEF DESCRIPTION OF DRAWINGS

FIG. 1 is a perspective view showing an item of apparel consisting of a cap, and showing the portable light assembly of the present invention as positioned on the cap for illuminating a logo contained thereon;

FIG. 2 is a side elevational view, taken in the direction of the arrows 2—2 of FIG. 1, illustrating the two components of the portable light assembly as installed on the wearing apparel of FIG. 1, namely a cap and in operative position with respect thereto;

FIG. 3 is a top cross-sectional view taken in the direction of the arrows of line 3—3 of FIG. 2, showing the details of construction of the two components of the light assembly in the manner in which the electrical circuitry is established between the two components;

FIG. 4 is a side elevational perspective view, in exploded format, showing the two components of the portable light assembly, and the cover of the housing containing the power source; and FIG. 5 is a side elevational view, in cross-section, showing the switch for operating the power source and the light of the portable light assembly of the present invention.

SUMMARY OF THE INVENTION

In summary, the present invention provides a lightweight portable light assembly intended for illuminating items such as logos or other designs contained on wearing apparel. The portable light assembly is designed so that the light intended for illumination purposes will be carried in a steady-burn circuit, and will have the light directed in a downward direction for illumination purposes.

Hence, the portable light assembly of the present invention consists of basically a two-component system, the first component consisting of a housing for accommodating the power source and related electrical circuitry and positive and negative leads which connect with a pair of stakes emanating outwardly from the housing, and a light carrying ledge having a pair of stake receiving apertures formed therein, the light having positive and negative leads extending therefrom and interconnected with the stake receiving apertures. In operation, the item of apparel having a logo to be illuminated is interposed between the housing and the light carrying ledge, such that the stakes may penetrate the clothing, and be inserted into the stake receiving apertures of the light ledge. Once the circuit is established, the switch contained on the housing is activated in order to activate the circuitry between the positive and negative lead terminals, thereby illuminating the light. The light is carried by the ledge in a position to be spaced away from the apparel for a distance, such that once activated, the light will illuminate in a downward direction thereby to illuminate the logo intended to be illuminated for attentiongetting purposes.

DETAILED DESCRIPTION OF DRAWINGS

As shown in FIG. 1, a typical item of apparel which contains a logo will consist of a cap 5, which will contain a logo, such as one identifying a sports team or other entity. Such caps are extremely prevalent and virtually worn by all segments of society. The portable light assembly generally represented by the numeral 10, is shown to be positioned on the cap 5, and in juxta position relative to the logo 8, in order to illuminate the logo 8, for attention focusing purposes.

As more specifically shown in FIG. 2, the portable light assembly 10 of the present invention consists of two components, the first component being a base 12 formed by a housing 14 containing a chamber 15 in which is carried a power source such as a battery 17. The chamber 15 carrying the battery 17 is provided with a positive terminal 18, and a negative terminal 19 (see FIG. 4). The respective positive terminal and negative terminals 18 and 19 are actually formed of metal strips in a manner commonly known in the art. It will be observed that the housing 14 includes a top wall 21 which has a switch aperture 22 formed therein, and accommodates a switch 24 carried in the switch aperture 22 (See FIG. 5).

As illustrated in FIGS. 3 and 4 of the drawings, the housing 14 has an open back end, which is enclosed by means of a housing cover 25 which may be designed to be slidably positioned over the housing 14. In this manner, the battery 17 contained within the chamber 15 of the housing 14 may be replaced from time to time by simply slidably disengaging the cover 25 from the housing 14 and changing the battery 17 after which the housing cover 25 is slidably re-engaged onto the housing 14. It is contemplated that structures of this type are well-known in the art.

It will further be observed that the housing 14 is provided with a pair of stakes 27 and 29 respectively which are mounted within the housing 14 and extend outwardly through appropriate stake apertures formed in the front wall of the housing 14 as illustrated in FIGS. 2 and 3 of the drawings. Each of the stakes 27 and 29 are provided with pointed ends, and are also knurled along the length thereof for a purpose to be more fully described hereinafter.

It will also be observed that the one stake 27 is in permanent contact with the positive terminal 18, and the opposed stake 29 is in permanent contact with the negative terminal 19. This is accomplished in a manner well-known in the art by simply having the metallic strips forming the positive and negative terminals 18 and 19 respectively soldered to each of the respective stakes 27 and 29. Hence, once a battery is positioned within the chamber 15 and enclosed by the housing cover 25, the stakes each constitute a positive and negative lead emanating from the power source, namely the battery 17, respectively.

As further illustrated in FIGS. 2 through 4 of the drawings, the other element of the portable light assembly consists of a light ledge 30. The ledge 30 is actually formed and bounded by a bottom wall 31, top wall 32, front wall 33, and rear wall 34. As shown in FIG. 2, the bottom wall 31 is provided with a light aperture 36 which contains a light-emitting diode 38 positioned therein. The light-emitting diode 38 is provided with a positive lead 39, and a negative lead 41. As specifically shown in FIGS. 3 and 4 of the drawings, the rear wall 34 of the light ledge 30 is provided with a pair of stake receiving apertures 42 and 43 respectively each of which is co-extensive with a stake chamber 44 and 45 respectively (see FIG. 3).

It will be observed that the positive lead 39 extending from the light 38 is mounted in the pin chamber 44, while the negative lead 41 extending from the light 38 is mounted in the opposed stake chamber 45 in a manner such that when the respective stakes 27 and 29 are inserted through the stake receiving apertures 42 and 43 and come to rest in the stake chambers 44 and 45, the stakes 27 and 29 are in touching contact with the positive and negative leads 39 and 41 respectively of the light-emitting diode 38. Hence, once the switch 24 is activated so that the negative terminal 19 contained in the housing is forced into touching contact with the battery, a steady circuit is established so that the light-emitting diode 38 is engergized in order to emit a steady stream of light.

It will be further observed that the light receiving aperture 36 contained in the ledge 30 is spaced a distance from the rear wall 34 of the ledge 30. Furthermore, the light is positioned in the bottom wall 31 of the ledge 30 such that once illuminated, the light will be forced to shine downwardly and by being spaced away from the rear wall 34 of the ledge 30, will be spaced sufficiently in order to fully illuminate a logo of the type contained and as illustrated in FIG. 1, representing the logo 8 on cap 5.

It will be appreciated that if the light is carried on the device too close to the material on which is contained the logo, the light will not adequately illuminate the logo, and the purpose for which the device was created would be lost. It is therefore important that the portable light assembly 10 of the present invention be designed such that a ledge is provided in order that the light may be spaced away from the material containing the logo when the two component light system is installed onto the material for the purpose of illuminating the logo or other design. Furthermore, it has been determined that if the spacing is too close, or too far from the clothing, improper illumination is achieved. From this standpoint, it has been found that a spacing of between one-quarter and one-half inch from the rear wall of the ledge appears to be adequate spacing in order to achieve maximum illumination of the logo when the light is positioned above the logo as illustrated in FIG. 1 of the drawings.

It will be appreciated from the above description that the present invention provides a light weight and portable illuminating light assembly for illuminating and highlighting logos or other designs contained on an item of apparel. The portable light assembly of the present invention is easily installed by means of stakes which may perforate the material containing the logo, and the logo light positioned in ideal position relative to any given logo regardless of where contained on the clothing, in order to illuminate the same.

While there has been described what is at present considered to be the preferred embodiments, it will be appreciated that all variations and modifications as may be contained therein are intended to be covered in the appended claims.

I claim:

1. A portable light assembly comprising a base formed by a housing having a top end and a bottom end, said housing including a chamber for accommodating a power source and related circuitry including a positive lead and a negative lead extending therefrom, said housing further provided with a pair of stakes positioned adjacent to the top end of said housing and extending substantially horizontally outwardly from said housing for a distance, each of said stakes being formed from an electroconductive material, said stakes each having an inner end positioned within said housing and an outer end spaced a distance from and positioned externally of said housing, said inner end of one stake being connected to said negative lead within said housing and said inner end of the other stake being connected to said positive lead within said housing, a light carrying ledge adapted for removable engagement with said housing, said ledge having a rear wall and bounded by top, bottom, front and side walls, said light carrying ledge formed by a housing containing a chamber for accommodating a light bulb having positive and negative leads extending therefrom and contained within said chamber, said ledge provided with a pair of stake apertures formed in said rear wall and spaced apart a distance equivalent to the spacing of said stakes and adapted to accommodate the insertion therein of said pair of stakes thereby to accommodate the mounting of said ledge onto said base, said stake apertures being formed from an electroconductive material, one of each of said light bulb leads being carried within a corresponding stake aperture, whereby said ledge may be mounted to said base at an angular disposition by inserting said stakes of said housing into said stake apertures of said ledge while simultaneously completing the circuit as between said power source and said light bulb and complete the assembly of said portable light assembly.

2. The portable light assembly as set forth in claim 1 above, wherein said power source comprises a battery having positive and negative terminals.

3. The portable light assembly as set forth in claim 2 above, wherein said bottom wall of said ledge includes a bulb aperture to accommodate the mounting therein of said light bulb such that said light bulb, when mounted, faces in a downward disposition relative to said ledge.

4. The portable light assembly as set forth in claim 3 above, wherein said bulb aperture and light bulb carried therein is spaced away from the rear wall of said ledge and adjacent the front wall thereof.

5. The portable light assembly as set forth in claim 4 above, wherein said light bulb, when mounted in said bulb aperture, is spaced forwardly between one quarter and onehalf inch from said rear wall of said ledge.

6. The portable light assembly as set forth in claim 1 above, wherein said outer end of each of said stakes is conical in configuration terminating in a pointed end.

7. The portable light assembly as set forth in claim 6 above, wherein said portable light assembly accommodates the interposition of a sheet of perforatable material between said light carrying ledge and said base while permitting said stakes and said base to penetrate said sheet of perforatable material and enter said stake receiving apertures in said ledge thereby to position said light bulb in overlying relation relative to said material in order to illuminate at least a portion of said material for display purposes.

8. The portable light assembly as set forth in claim 1 above, wherein said ledge, when mounted onto said base is positioned horizontally and at right angles thereto.

* * * * *